United States Patent [19]

Harrington

[11] 4,182,005

[45] Jan. 8, 1980

[54] ELECTRICAL CORD HOLDER

[76] Inventor: Michael L. Harrington, 3514 Military Ave., Los Angeles, Calif. 90034

[21] Appl. No.: 900,590

[22] Filed: Apr. 27, 1978

[51] Int. Cl.[2] ..... F16L 33/00; A44B 21/00

[52] U.S. Cl. ..... 24/16 PB; 24/81 CC; 279/1 K; 339/119 C

[58] Field of Search ..... 24/81 SK, 129 D, 16 PB, 24/81 CC; 248/74 PB

[56] References Cited

U.S. PATENT DOCUMENTS

| | | | |
|---|---|---|---|
| 2,257,559 | 9/1941 | Albertson | 24/129 D |
| 3,118,200 | 1/1964 | Bell | 24/16 PB |
| 3,197,830 | 8/1965 | Hoadley | 24/16 PB |
| 3,601,863 | 8/1971 | Dorsey | 24/16 PB |
| 3,875,620 | 4/1975 | Wells | 24/16 PB |

FOREIGN PATENT DOCUMENTS

| | | | |
|---|---|---|---|
| 2360992 | 7/1974 | Fed. Rep. of Germany | 24/16 PB |
| 1480386 | 4/1967 | France | 248/74 PB |
| 386327 | 4/1965 | Switzerland | 24/16 PB |
| 581288 | 6/1974 | Switzerland | 248/74 PB |

*Primary Examiner*—Bernard A. Gelak
*Attorney, Agent, or Firm*—Ralph B. Pastoriza

[57] ABSTRACT

The cord holder comprises a body with an integrally formed strap arranged to encircle an end portion of an electrical cord and thence be fed through a first slot in the body. By cinching up on the strap, the body becomes a permanent part of the electrical chord. The remaining portion of the strap can be formed into a large loop to engage about multiple windings of the cord when it is wound up for storage. The free end of the strap is then passed through a second slot in the body and hooked over an appropriate projection on the body to thereby hold the cord in its wound configuration.

5 Claims, 5 Drawing Figures

ELECTRICAL CORD HOLDER

This invention relates generally to holding devices and more particularly to a cord holder designed in its preferred embodiment for holding electrical cords such as extension cords in wound up condition for easy storage.

BACKGROUND OF THE INVENTION

Various devices such as simple strap bands are well known in the art for securing together windings of cords and the like when wound up for storage. In fact, where such bands or straps are not available, simple elastic bands may be used for this purpose.

More sophisticated arrangements are also known for storing electrical cord; for example, wind up drums and the like built into vacuum cleaners for storing the electrical cord of the cleaner.

Despite the obvious convenience of providing some type of cord holding arrangement to facilitate storing electrical cords such as extension wires, cords on smaller appliances such as hand-held drills or saws and the like, there is really not available a cord holder which is always available for immediate use for such purpose. While tie straps, rubber bands and the like can be used, they are always separate items from the cord itself with the result that they become lost or not readily available.

It would be highly desirable if a simple and inexpensive cord holder could be provided capable of being readily secured to any particular cord or cords such as extension cords or the cords associated with small appliances to hold them in a wound up or stored position when not in use.

BRIEF DESCRIPTION OF THE PRESENT INVENTION

With the foregoing considerations in mind, the present invention contemplates a particularly designed cord holder meeting the foregoing objective of always being available for immediate use in that the same can be purchased as a separate item and readily attached without any special tools to any particular cord.

Briefly, and in its broadest aspect, the cord holder of this invention comprises a body having means for securing the body to a portion of a cord such as an electrical cord. Strap means are provided having one end secured to the body and the remaining portion free to wrap about multiple windings of the cord when the cord is wound up for storage. Finally, means are provided on the body for securing the remaining portion after wrapping the strap around the multiple windings to the body to thereby hold the cord in its wound up condition.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
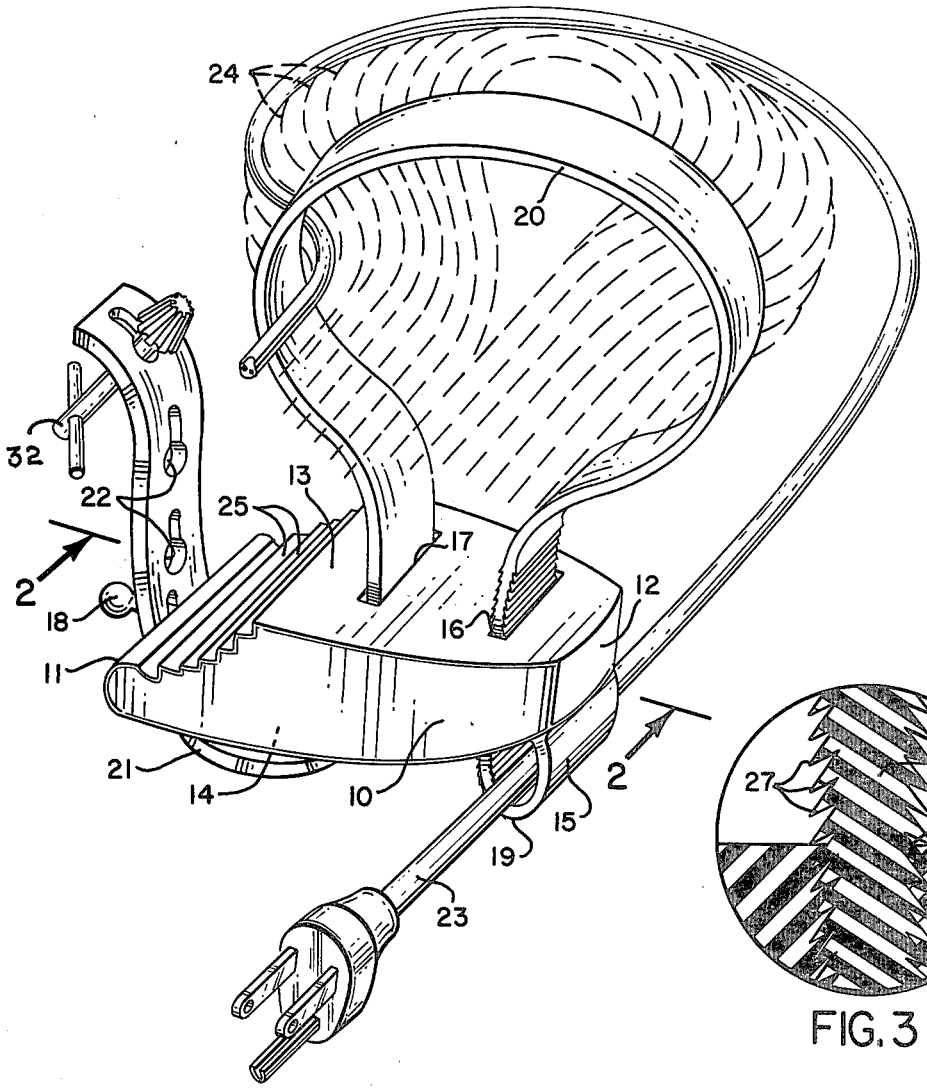
FIG. 1 is an enlarged perspective view of the cord holder of this invention illustrating the manner in which it will hold multiple windings of an electrical cord wound up for storage purposes.

Referring first to FIG. 1, the cord holder is comprised of an integral body 10 preferably of plastic such as, for example, polypropylene. Body 10 has front, rear, top and bottom portions 11, 12, 13 and 14 respectively, there being provided a strap 15 integrally extending from the rear portion 12.

The central portion of the body is provided with first and second transverse slots 16 and 17 passing from the bottom to the top between the front and rear portions 11 and 12. In addition, body 10 includes in the embodiment of FIG. 1 an integrally formed forwardly extending projection 18 from the front 11.

With the foregoing arrangement and a relatively long strap 15, the strap is arranged to form a small loop 19 between the rear portion 12 where it is secured and the entrance portion of the bottom 14 of the slot 16, the strap passing up through this slot as shown. The remaining free portion of the strap passing through the first slot 16 in turn is arranged to form a large loop 20 and thence be passed down through the second slot 17. An end section 21 of the strap is provided with a series of openings 22 such that this end section after passing through the second slot can be turned upwardly past the front portion 11 of the body and the projection 18 received in one of the openings 22.

In use, the end portion 23 of an electrical cord is passed through the small loop 19 and this small loop contracted about the end portion by pulling the strap upwardly through the first slot 16 as indicated by the arrow. The small loop 19 thus secures the body 10 to this end portion of the cord. The remaining portion of the electrical cord can then be wound up to form multiple windings indicated in phantom lines at 24 and held within the large loop 20 of the strap, pulling of the end section 21 of the strap down through the second slot 17 contracting the larger loop 20 about the wound up remaining portion of the cord. An appropriate opening 22 juxtaposed the projection 18 will then receive the projection 18 to hold the cord and thus maintain the large loop 20 contracted about the windings to hold the electrical cord in its wound up configuration for easy storage.

Figure 2:
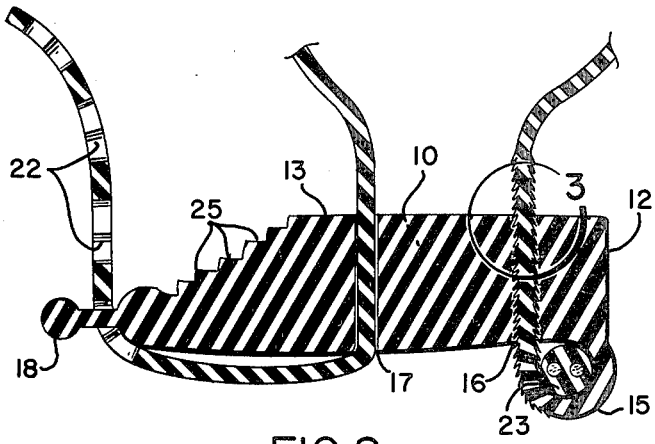
FIG. 2 is a fragmentary cross section taken in the direction of the arrows 2—2 of FIG. 1.

FIG. 2 illustrates a cross section through the slots 16 and 17 and it will be noted that the walls of the first slot and opposite sides of the strap 15 passing upwardly therethrough include serrations. These serrations are so directed as to permit upward movement of the strap through the slot but block downward movement of the strap. As a consequence, the strap can be cinched about the end portion 23 of the electrical cord to thoroughly secure the body 12 to the cord in a more or less permanent manner.

FIG. 2 illustrates more clearly the integral extending projection 18 passing through one of the openings 22. By providing a series of such openings, the large loop 20 can be sized to accommodate the particular length of the electrical cord involved so that should the multiple windings be large in number, one of the openings closer to the end of the strap would be used whereas if the electrical cord is fairly short requiring only a few windings, the large loop 20 can be cinched about these windings and one of the openings further spaced from the extreme end of the strap utilized to hold it in a snug configuration. The front and top edge of the body 10 may include a beveled portion provided with serrations 25 for a user's thumb to facilitate gripping the body in the fastening of the strap section opening to the projection 18.

Figure 3:
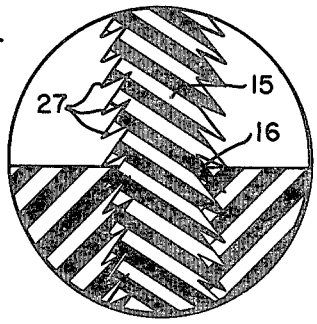
FIG. 3 is an enlarged fragmentary cross section of a portion of the structure enclosed within the circular arrow 3 of FIG. 2.

Referring now to FIG. 3, there is shown the preferred form of serrations described in FIG. 2 wherein it will be noted that the opposite walls of the slot 16 include inwardly and upwardly extending sawteeth 26 for cooperation with downwardly and outwardly extending sawteeth 27 on opposite sides of the strap portion 15. It will be appreciated that the strap can be moved upwardly through the slot 16 with the serrations passing over each other whereas it is locked against downward movement because of the orientation of the serrations. As mentioned, with this arrangement the body 10 will be effectively permanently secured to the electrical cord involved so that there is no chance of it becoming lost.

Figure 4:
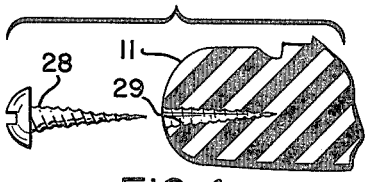
FIG. 4 is a fragmentary cross section illustrating an alternative construction for a portion of the cord holder.

FIG. 4 illustrates an alternative to an integral extending projection such as the projection 18 for cooperation with the openings 22 in the strap. This alternative takes the form of a metal insert 28 such as a screw which can be self-threaded into the front 11 of the body or within appropriately tapped screw threads 29 as shown. Where a great deal of tension might be placed on this portion of the strap, a metal insert could provide a more secure attachment.

Figure 5:
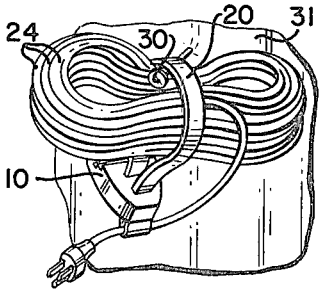
FIG. 5 is a perspective view of the manner in which the cord holder with a cord held therein can be suspended from a wall for storage.

FIG. 5 illustrates in perspective view how a simple electrical cord might be stored using the cord holder of this invention. Thus, there is shown the large loop 20 of the strap encircling the various windings 24 of a cord, a portion of the strap being utilized to suspend the cord from a nail 30 in a wall 31.

When it is desired to use the cord, the end section of the strap 21 shown in FIG. 1 is simply unhooked from the projection 18 and the strap pulled up through the second slot 17 which is not provided with any serrations so that the strap can move fairly easily through the slot. The various multiple windings 24 of the cord are thus freed and the cord can be used in any desired manner, the body 10 always being secured thereto by the small loop 19 as described.

When a user has finished with the cord, the cord is simply wound up in the usual manner and the strap wrapped about the multiple loops with the end then passed through the second opening 17 and hooked to the projection 18 all as described.

It should be understood that the holder as described in FIG. 1 is well suited to small hand tools such as quarter inch drills, saber saws, rotary saws, sanders and the like. Thus, the body 10 can simply be permanently attached to a portion of the cord either towards the plug end shown in FIG. 1 or towards the place where the cord extends from the tool. Whenever a person is through using the tool, he thus has available to him in a very handy strap structure for holding the wound up cord in a neat array for storage with the tool. Further, any one of the exposed openings 22 in the end portion of the strap 20 can be used to hold a chuck key for the tool in question. Such a chuck key is shown at 32 in FIG. 1. The end portion of the strap can also be looped back and the end opening 22 inserted over the projection 18 to define a loop for hanging the tool.

The holder will also be very useful simply for storing extension cords and the like.

Finally, while the holder has been described for use with an electrical cord, it could readily be utilized for any type of cord which is normally wound up when not in use even to small garden hoses or similar type structures. The invention, accordingly, is not to be thought of as limited to any one specific use although the preferred embodiment described will best be suited to electrical cords.

I claim:

1. An electrical cord holder comprised of an integral body of polypropylene having front, rear, top and bottom portions and including:

(a) a strap integrally extending from said rear portion, (b) said body having first and second transverse slots passing from the bottom to the top of said body between the front and rear portions, and (c) a projection extending forwardly from the front of said body, (d) said strap forming a small loop and thence passing up through said first slot and thence forming a large loop and thence passing back down through said second slot, (e) an end section of the strap having a series of projection receiving openings so that said end section after passing through said second slot can be turned upwardly past the front portion of said body and said projection received in one of said openings, the opposite side walls of said first slot having inwardly and upwardly directed sawtooth serrations and the opposite sides of a portion only of said strap passing through said first slot having outwardly and downwardly directed sawtooth serrations, the remaining portions of the strap being free of serrations, such that the sawtooth serrations on the slot and on the strap portion will interlock and prevent downward movement of the strap through said first slot whereby an end portion of an electrical cord can be passed through said small loop and said small loop contracted about the end portion by pulling the strap upwardly through the first slot thereby securing the body to said end portion of said electrical cord so that it becomes permanently attached and is always available for use, and, whereby thereafter the remaining portion of the electrical cord can be wound up and held in said large loop, pulling of the end section of said strap down through said second slot contracting the large loop about the wound up remaining portion of the cord and subseuuently passing the projection through a juxtaposed opening in said strap section holding the large loop in its contracted state to thereby secure the electrical cord in its wound up configuration for easy storage.

2. A cord holder according to claim 1, in which the top and front edge of said body is beveled and serrated to provide a thumb grip for a user in securing said strap to said projection.

3. A cord holder according to claim 2, in which said projection constitutes an integral part of said body.

4. A cord holder according to claim 2, in which said projection constitutes a metal insert secured to the front portion of said body.

5. A cord holder according to claim 1, in which each of said projection receiving openings is dimensioned to receive a chuck key for storage when said electrical cord is associated with an electric drill.

* * * * *